United States Patent [19]

Noakes et al.

[11] Patent Number: 4,854,506

[45] Date of Patent: Aug. 8, 1989

[54] ELECTROSTATIC SPRAYING

[75] Inventors: Timothy J. Noakes, Hampshire; Nevil E. Hewitt, Surrey, both of England

[73] Assignee: Imperial Chemical Industries plc, London, England

[21] Appl. No.: 139,142

[22] Filed: Dec. 21, 1987

Related U.S. Application Data

[63] Continuation of Ser. No. 811,445, Dec. 20, 1985, abandoned.

[30] Foreign Application Priority Data

Dec. 20, 1984 [GB] United Kingdom ..... 8432274

[51] Int. Cl.[4] ..... B05B 5/00

[52] U.S. Cl. ..... 239/691; 239/698; 239/707; 239/708

[58] Field of Search ..... 239/3, 690, 691, 697, 239/698, 706, 707, 498, 597–599

[56] References Cited

U.S. PATENT DOCUMENTS

| | | | |
|---|---|---|---|
| 820,328 | 5/1906 | Alderman | 239/498 |
| 2,658,009 | 11/1953 | Ransburg | 239/3 X |
| 3,656,171 | 4/1972 | Robertson | 239/690 X |
| 3,680,779 | 8/1972 | Reilly | 239/3 |
| 3,937,401 | 2/1976 | Luderer et al. | 239/707 |
| 4,144,110 | 3/1979 | Luc | 156/73.5 |
| 4,356,528 | 10/1982 | Coffee | 239/690 X |
| 4,515,105 | 5/1985 | Danta et al. | 239/707 X |
| 4,555,698 | 11/1985 | Clark et al. | 340/680 |
| 4,576,827 | 3/1986 | Hastings et al. | 239/3 X |

OTHER PUBLICATIONS

Fink, Donald G., *Electronics Engineers Handbook*, 1975, pp. 1–10, 6–3, 6–6.

*Primary Examiner*—Andres Kashnikow
*Assistant Examiner*—Patrick N. Burkhart
*Attorney, Agent, or Firm*—Cushman, Darby & Cushman

[57] ABSTRACT

An electrostatic spraying apparatus in which an electrode is mounted adjacent to the sprayhead, means are provided for causing a first electrical potential to be applied to liquid emerging from the sprayhead, and further means are provided for applying a second electrical potential to the electrode. The difference between the first and second potentials is sufficient to cause an intense field to be developed between the emerging liquid and the electrode, sufficient to atomise the liquid. The electrode has a core of conducting or semiconducting material sheathed in a "semi-insulating" material. This "semi-insulating" material has a dielectric strength and volume resistivity sufficiently high to prevent sparking between the electrode and the sprayhead and a volume resistivity sufficiently low to allow charge collected on the surface of the material to be conducted through the "semi-insulating" material to the conducting or semiconducting core.

18 Claims, 4 Drawing Sheets

ELECTROSTATIC SPRAYING

This is a continuation of application Ser. No. 811,445, filed Dec. 20, 1985, now abandoned.

BACKGROUND OF THE INVENTION

This invention relates to electrostatic spraying.

Our UK specification No. 1 569 707 discloses an electrostatic spraying apparatus wherein a sprayhead has a conducting or semiconducting surface which is charged to a potential of the order of 1 to 20 Kilovolts and a field intensifying electrode which is mounted adjacent to the surface and is connected to earth (ground) potential. When spraying liquid is delivered to the sprayhead, the electrostatic field at the surface is sufficient to cause liquid to be atomized without substantial corona discharge. Charged particles of liquid emerging from the sprayhead are projected past the electrode to a target, which is also at earth potential.

The provision of the earthed field intensifying electrode offers three advantages. First, the electrostatic field at the conducting or semiconducting surface is greater than it would otherwise be, since the electrode is much closer to the surface than is the target. This means that the potential applied to the surface can be lower, which means that a cheaper and safer generator can be employed. Secondly, the spacing between the electrode and the conducting or semiconducting surface, and hence the electrostatic field at the surface, is constant. In spraying operations which involve movement of a sprayhead relative to a target, such as crop spraying, there can be major variations in the spacing between the sprayhead and the target. If there is no field intensifying electrode, such variations in spacing cause corresponding variations in the effective electrostatic field. Finally, in spraying operations which produce small, satellite droplets of spraying liquid, such smaller particles can be attracted to the field intensifying electrode.

In large scale agricultural spraying there is a continual demand for apparatus capable of operating at higher flow rates and there is also a demand for smaller droplet size, for example, down to approximately 30 μm diameter. These demands are conflicting, since increasing the flowrate produces an increase in the size of the droplets, other parameters remaining constant. Moreover, the combination of a high flowrate and a small droplet size causes a large "back spray" of droplets, which are repelled away from the main body of droplets and settle on the apparatus or drift away into the air.

SUMMARY OF THE INVENTION

According to the invention there is provided electrostatic spraying apparatus comprising an electrostatic sprayhead, means for causing a first electrical potential to be applied to liquid which emerges from the sprayhead, an electrode mounted adjacent to the sprayhead, and means for applying a second electrical potential to the electrode such that an intense electrical field is developed between the emerging liquid and the electrode, the intensity of the field being sufficient to cause atomization of liquid. The electrode comprises a core of conducting or semiconducting material sheathed in a material of dielectric strength greater than 15 KV/mm and volume resistivity between $5\times10^{11}$ and $5\times10^{13}$ ohm cms. The dielectric strength and volume resistivity are sufficiently high to prevent sparking between the electrode and the sprayhead, while the volume resistivity is sufficiently low to allow charge collected on the surface of the sheathing material to be conducted through the material to the conducting or semiconducting core.

The apparatus may further comprise insulating means so arranged that the resistance to a flow of the said charge across the surface of the sheathing material to the said conducting or semiconducting core is greater than the resistance to a flow of the said charge through the sheathing material to the conducting or semiconducting core. Suitably, the means for applying the second electrical potential then includes an electrical conductor which is electrically connected to the conducting or semiconducting core and has a cover of insulating material, and the insulating means is provided between engaging parts of the sheathing material and the cover.

The sprayhead may include an orifice of generally circular section with the electrode generally circular. Alternatively, the sprayhead may include an orifice of generally annular section and the electrode comprises a generally ring-shaped electrode element and/or a generally disc-shaped electrode element. Alternatively, the sprayhead may have a linear orifice, in which case the electrode comprises two mutually spaced, parallel arranged linear electrode elements.

It has been found that this "semi-insulating" sheath on the electrode has a number of benefits and that the properties of the material, especially the volume resistivity, have a major effect on the performance and reliability of our sprayers. The "semi-insulating" sheath provides a high local resistance between the sprayhead and the conducting core of the adjacent electrode, thus enabling the potential at any point of the outside surface of the sheath to vary from the potential applied to the core according to the local current flow. This suppresses disruptive sparking between the sprayhead and the electrode and enables a higher potential difference to be maintained between the sprayhead and the electrode. It also suppresses disruptive corona which can result from a fibre or other dirt landing on the electrode. In addition, it reduces the degrading effect on atomization of mechanical defects and of accidental liquid build-up on the electrode. In particular, the exact location of the electrode relative to the sprayhead is less critical.

Whilst the above benefits rely on the sheathing material having a sufficiently high volume resistivity, if the resistivity is too high the leakage of charge through the material can be too low, and hence the atomization is impaired. In agriculture, the upper limit on the volume resistivity is determined by the need for the sprayer to operate in both low and high humidities. It has been found that the volume resistivity of the sheathing material must be chosen to optimize a sprayer's performance and reliability, and is generally between $5\times10^{11}$ and $5\times10^{13}$ ohm cms.

As hereinafter explained, a specific resistance R can be defined for sheathing material in tubular form. The preferred value for the specific resistance is between $5\times10^{10}$ and $5\times10^{12}$ ohm cms.

The dielectric strength of the material and the thickness of the sheath must be sufficient to withstand the potential difference between the sprayhead and conducting core of the electrode without electrical breakdown. The dielectric strength of the sheathing material is suitably above 15 KV/mm and the thickness of the sheath is suitably 0.75 to 5.0 mms., preferably 1.5 to 3.5 mms. For use as an agricultural sprayer, the sheathing material must be both mechanically and electrically stable to the range of agrochemicals sprayed and to the weather conditions. The sheath must also be mechanically robust.

Preferably, the second electrical potential has the same polarity as the first electrical potential and is intermediate the first electrical potential and the potential of a target sprayed by the apparatus, the second potential being sufficiently different from the first potential for the liquid to be atomized but sufficiently close to the first potential for charged droplets of the liquid to be repelled away from the sprayhead and towards the target.

According to the invention there is also provided a process for spraying liquids comprising supplying a liquid to an electrostatic sprayhead, causing a first electrical potential to be applied to liquid which emerges from the sprayhead, and applying a second electrical potential to an electrode mounted adjacent to an outlet from the sprayhead. The second electrical potential is such that an intense electrical field is developed between the emerging liquid and the electrode, the intensity of the field is sufficient to cause atomization of the liquid. The electrode comprises a core of conducting or semiconducting material sheathed in a material of dielectric strength greater than 15 KV/mm and volume resistivity between $5\times10^{11}$ and $5\times10^{13}$ ohm cms. The dielectric strength and volume resistivity are sufficiently high to prevent sparking between the electrode and the sprayhead, while the volume resistivity is sufficiently low to allow charge collected on the surface of the sheathing material to be conducted through that material to the conducting or semiconducting core.

BRIEF DESCRIPTION OF THE DRAWINGS

The invention will now be described, by way of example, with reference to the accompanying drawings, in which:

FIG. 10 is a section of the sheath and conductor connection.

DETAILED DESCRIPTION OF THE PREFERRED EMBODIMENT

Figure 1:
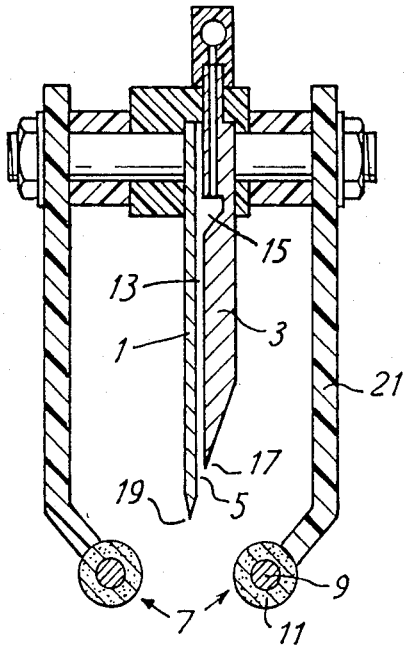
FIG. 1 is a section of a sprayhead and associated electrode in a first electrostatic spraying apparatus according to the invention.

The sprayhead shown in FIG. 1 of the drawings forms part of a tractor mounted apparatus for spraying crops with pesticide compositions. Included in the sprayhead are two upstanding plates 1 and 3 which are mutually spaced and parallel arranged. Each plate is formed of brass or some other conducting or semiconducting material. The space between the plates 1 and 3 forms a channel 13 through which spraying liquid can flow downwardly from a distribution gallery 15 to a linear orifice 5 formed at a lower straight edge 17 of the plate 3 and an adjacent part of the plate 1. A lower edge 19 of the plate 1 is generally parallel with but is located a short distance below (ie. downstream of) the lower edge 17 of the plate 3. The edge 19 has a radius preferably less than 0.5 mm.

Adjacent the orifice 5 are two linear electrode elements 7 which form an electrode of the present sprayhead. The electrode elements 7 are supported by respective sheets 21 of insulating material.

Each electrode element 7 is formed of a core 9 having a diameter of 3 to 4 mms. and a sheath 11 of "semi-insulating" material. The material of the sheath has a resistivity within the range $5\times10^{11}$ to $5\times10^{13}$ ohm cms. and a thickness of approximately 2 mms. Examples of suitable sheathing material are certain grades of soda glass and phenol-formaldehyde/paper composites. Kite brand tubes supplied by Tufnol Limited of Birmingham, England have been found particularly suitable for agricultural sprayers. The core 9 of each element 7 is formed of beads of carbon, tightly packed within the sheath 11.

There is a spacing of approximately 10 mms. between each electrode element 7 and the lower edge 19 of the element 1 and a spacing of approximately 16 mms. between the axes of the two electrode elements 7.

A high voltage generator is connected to the plate 1 so that the plate is maintained at an electrical potential of 40 KV. The electrode elements 7 are connected to a tapping on the generator and are maintained at an intermediate potential of approximately 25 KV.

Connection between the generator and each electrode element 7 is effected by means of a high voltage lead having an electrical conductor 201 inside a cover of polythene 203 or other insulating material. A short end section of the cover is formed with an external thread which engages an internal thread in an end section of the sheath 11, the conductor projecting beyond the cover to make an electrical connection with the core 9. To ensure a satisfactory connection between the lead and the element 7, as hereinafter described, a thermosetting epoxy resin 205 is applied to the threaded end sections of the cover and the sheath prior to engagement see FIG. 10.

In use, the sprayhead of FIG. 1 is connected to a tank (not shown) containing a liquid pesticide having a volume resistivity of $10^6$ to $10^{11}$ ohms cms., preferably $10^7$ to $10^{10}$ ohm cms.

The sprayhead is located about 40 cms. above a crop and the tractor carrying the sprayhead is driven over the ground.

Liquid from the tank is supplied to the gallery 15, from which it flows downwardly through the channel 13 between the plates 1 and 3 to the orifice 5. The liquid finally flows across one side of the plate 1 before reaching the sharp lower edge 19 of that plate.

Figure 2:
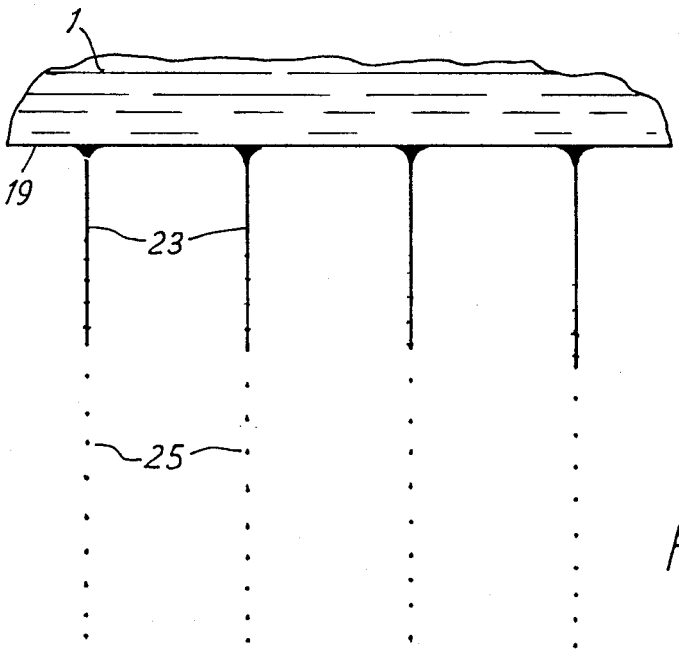
FIG. 2 is a side elevation of an atomizing edge with spraying liquid emerging therefrom during use of the sprayhead of FIG. 1.

Liquid contacting the plate 1 is subjected to the same electrical potential as the potential applied to that plate. When the liquid reaches the edge 19 it is subjected to an intense electrostatic field which exists between the plate 1 and the electrode elements 7. Referring to FIG. 2 of the drawings, the intensity of the field is such that the liquid is formed into a series of ligaments 23 as it leaves the lower edge 19 of the plate 1 and moves downwardly towards the crop. Each ligament 23 is subsequently atomized into a series of droplets 25. The spacing between adjacent ligaments 23 is determined by the magnitude of the electrical potentials on the plate 1 and the electrode elements 7, the properties of the liquid, and the flow rate, and is typically between 0.5 and 5 mm.

At high flow rates of 250 ccs./min per meter of the edge 19, the intensity of the electrostatic field is still sufficient to cause atomization into droplets having a diameter of the order of 100 μm. Sparking between the plates 1 and 3 and the electrode elements 7 is prevented, however, by the sheath 11 of each element.

As spraying continues there is a tendency for the space charge formed by the cloud of droplets between the sprayhead and the crop to repel further droplets emerging from the atomizing edge 19 upwardly towards other parts of the spraying apparatus or parts of the tractor. The potential on the electrode elements 7, which has the same polarity as the charge on the droplets, serves to repel the droplets downwardly towards the crop. Any charge which does collect on the elements 7 themselves is conducted away via the sheath 11 and core 9.

In this connection, it will be appreciated that "semi-insulating materials" suitable for use as the material for the sheath 11 generally have a surface resistivity which is variable, according to the amount of gaseous absorption thereon and other factors, but which is usually lower than the volume resistivity. Unless special precautions are taken in constructing the electrode element 7, there is a danger that charge collected on the surface of the outer surface of the sheath 11 will flow along that surface to one end of the sheath, across an annular end surface of the sheath, between the internal surface of the sheath and the outer surface of the polythene cover on the high voltage lead, and finally to the core 9 of the element 7 and the conductor of the lead. Any flow of charge along an outer surface of the sheath 11 causes a potential difference to be established between different parts of the surface. This means that the potential difference between liquid emerging from the orifice 5 and the electrode elements 7 varies according to location along the lengths of the orifice and the element. This in turn results in a variable electrical field between the emerging liquid and the electrode elements and hence uneven spraying. It is to prevent or substantially to prevent such a flow of charge across the surface of the sheath 11 to the core 9 that the above-mentioned epoxy resin is provided between the threadably engaging end sections of the sheath and the insulating cover on the high voltage lead.

The construction of the sprayhead shown in FIG. 1 can be modified by making one of the plates 1 and 3 from a conducting or semiconducting material and the other plate from non-conducting material.

Figure 3:
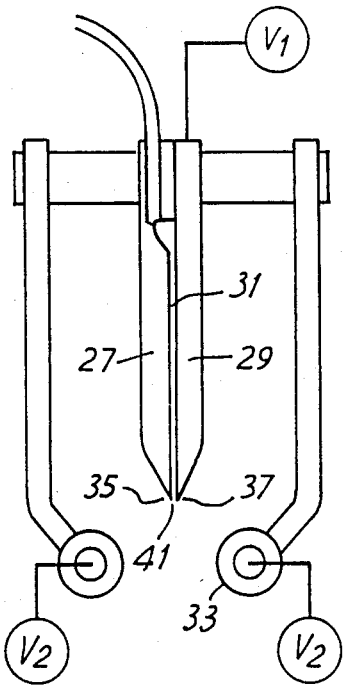
FIGS. 3 to 8 show diagrammatically sprayheads and associated electrodes in further spraying apparatus according to the invention.

Referring now to FIG. 3 of the drawings, a second sprayhead according to the invention has a similar construction to the sprayhead of FIG. 1, there being a pair of upstanding plates 27 and 29 corresponding to respective plates 1 and 3 of FIG. 1, a channel 31 corresponding to the channel 13, and electrodes 33 corresponding to electrodes 7. In the sprayhead of FIG. 3, however, a lower edge 35 of the plate 27 is disposed at the same vertical location as a lower edge 37 of the plate 29. The lower edges 35 and 37 define an orifice in the form of a slot 41 from which atomization of liquid takes place.

In a preferred construction of the apparatus of FIG. 3, the slot 41 has a length of 50 cms. and a width of 125 μm. Each of the electrodes 33 has a sheath of Kite brand Tufnol tubing and a core of carbon beads. The core is 6 mms. diameter and the outside diameter of the sheath is 1 cms. The axis of each electrode 33 is 4 mms. below the slot 41 and there is a spacing of 24 mms. between the axes of respective electrodes. A voltage of 40 KV is applied to the plates 27 and 29 of the sprayhead and a voltage of 24 KV is applied to the electrodes 33. In use, the sprayhead is located 30 cms. away from a target, which is at earth potential.

The apparatus has been used for spraying a mixture of white oil and cyclohexanone, the mixture having a resistivity of $5\times10^8$ ohm. cms. and a viscosity of 8 CSt.

At flowrates of 0.5, 1.0 and 2.0 ccs/sec, the volume median diameters of droplets from the sprayhead were 45, 60 and 95 μm, respectively.

If the sheathing material is removed from each electrode 33 and the above-mentioned voltages are maintained, there is heavy sparking and no effective spraying. To avoid sparking it is necessary to reduce the differential voltage between the plates 27 and 29 and the electrodes 33 to about 8 KV ie. the plates 27 and 29 are maintained at 40 KV and the electrodes 33 at 32 KV. Spraying is then possible but at a much reduced performance, flowrates of 0.5 and 1.0 ccs/sec giving droplets of volume median diameters of approximately 150 and 250 μm, respectively. At a flowrate of 2.0 ccs/sec the mixture of liquids merely drips from the slot 41.

Figure 4:
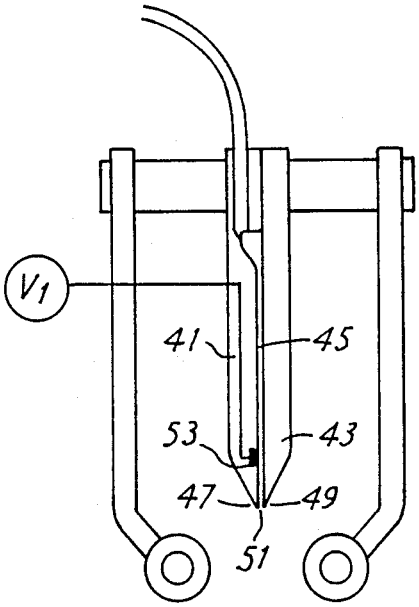

In a third sprayhead according to the invention shown in FIG. 4, a pair of upstanding plates 41 and 43 defining a liquid channel 45 are made of insulating material. As in the embodiment of FIG. 3, the plates 41 and 43 have their lower edges 47 and 49, respectively, at the same vertical location so that an atomized slot 51 is defined by those edges.

To enable an electrical potential to be applied to liquid in the sprayhead of FIG. 4, an electrode 53 is provided on that surface of the plate 41 which is adjacent to the plate 43 and which, in use, is contacted by liquid. As shown in FIG. 4, the electrode 53 is connected to a voltage generator $V_1$.

In using the sprayhead of FIG. 4 there is only a small potential difference between the electrical potential $V_1$ on the electrode 53 and the potential of the liquid at the slot 51. Accordingly, liquid emerging from the slot 51 is subjected to a similarly intense electrostatic field to the field at the lower edge 19 of the plate 1 in FIG. 1. The emerging liquid is therefore formed into ligaments and atomized in the manner described above.

Figure 5:
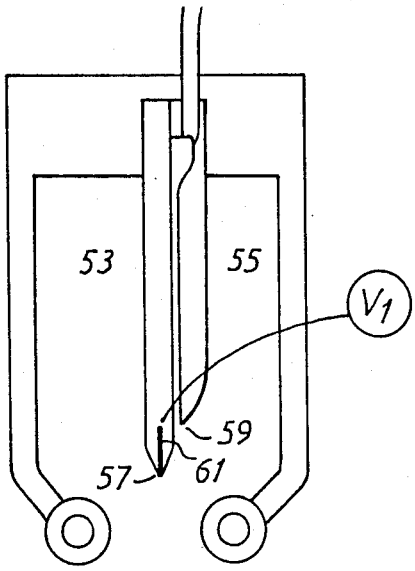

FIG. 5 shows a fourth sprayhead according to the invention in which two upstanding plates 53 and 55, respectively, are arranged with a lower edge 57 of the plate 53 a short distance below a lower edge 59 of the plate 55. The plates 55 and 57 are made of insulating material and an electrode 61 is provided in the material of the plate 53 at the lower edge 57 thereof. As in the sprayhead of FIG. 4, the electrode 61 is connected to a voltage generator $V_1$.

Figure 6:
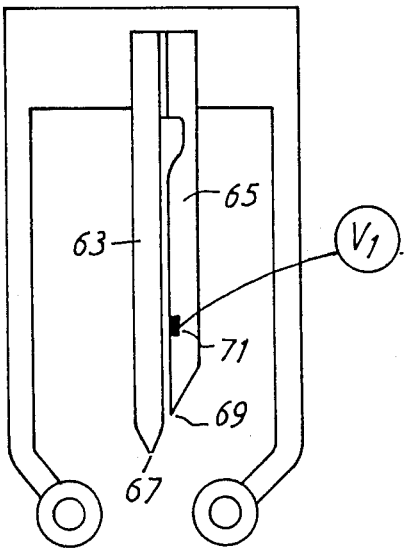

FIG. 6 shows a further sprayhead according to the invention in which upstanding plates 63 and 65 of insulating material are arranged with a lower edge 67 of the plate 63 a short distance below a lower edge 69 of the plate 65. An electrode 71 is provided at the surface of the plate 65 which faces the plate 63 and defines one side of the channel between the plates 63 and 65.

In the sprayheads described above, liquid emerging from a sprayhead is atomized from a straight edge (as in FIGS. 1, 5 and 6) or from a slot (as in FIGS. 3 and 4). In alternative arrangements, shown in FIGS. 7 and 8, the edge or slot is circular.

Figure 7:
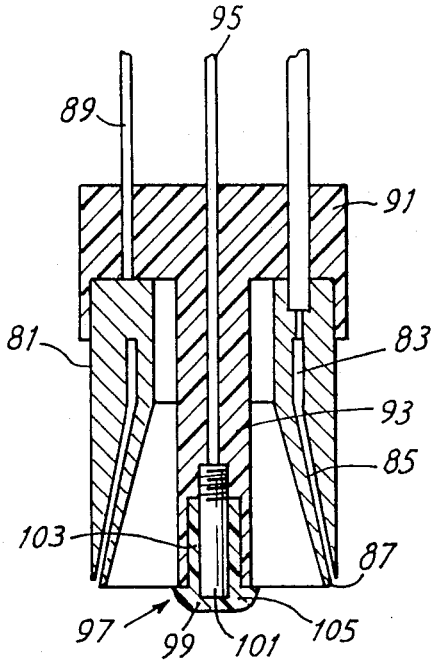

Referring to FIG. 7 of the drawings, a further sprayhead according to the invention includes a hollow, cylindrical nozzle member 81 which is formed with a distribution gallery 83 and a channel 85. At a lower end of the channel 83 is an annular orifice 87. The member 81 is made of conducting or semiconducting material and is connected via a high voltage lead 89 to a high voltage generator (not shown).

The member 81 depends from a polypropylene holder 91 which has a stem 93 extending downwardly, coaxially of the member. The stem 93 serves as an insulating cover for a conductor 95 which is connected to a tapping on the generator. Additionally, the stem 93 provides support for an electrode 97 connected to a lower end of the conductor 95.

The electrode 97 has a sheath 99 of "semi-insulating" material and a core 101 of brass or other conducting or semiconducting material.

As shown in FIG. 7, the sheath 99 includes a cylindrical section 103 which is received within a main recess at a lower end of the stem 93, and a disc-shaped section 105 which engages the lower end of the stem. The core 101 of the electrode 97 has a threaded upper end which is engaged with an internally threaded subsidiary recess above the main recess in the stem 93.

In use, the electrode 97 operates in a similar manner to the corresponding electrodes in the embodiments described above. However, in the apparatus of FIG. 7 the cylindrical section 103 of the sheath 99 is an interference fit within the main recess in the stem 93 so that there is a minimal flow of charge from the section 105 along the cylindrical surface of the section 103 and across an upper, annular end surface of that section to the core 101. In any event, the radial distance between the cylindrical surface of the section 103 and the core 101 is sufficiently small for charge to leak through the bulk of the sheathing material to the core rather than to flow via the cylindrical and end surfaces of the section 103. Accordingly, in the embodiment of FIG. 7 it is not necessary to provide insulating material between the threads on the upper end of the core 101 and the subsidiary recess in the stem 93.

Figure 8:
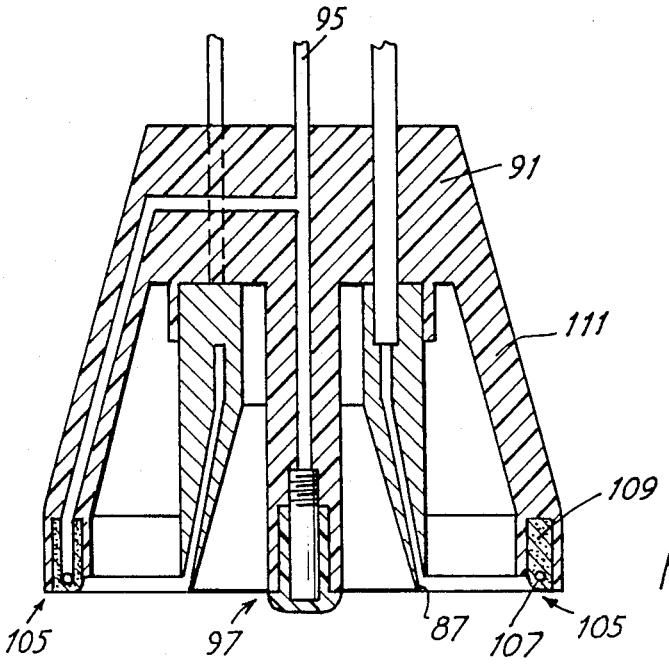

FIG. 8 shows an embodiment of the invention which corresponds to the embodiment of FIG. 7 except for the provision of a second electrode element 105. The element 105 is generally circular and is disposed radially outwardly of the orifice 87. As shown in FIG. 8, the element 105 has a core 107 of brass wire and a sheath 109 of "semi-insulating" material. The sheath 109 is fitted into an annular recess in a lower end of a skirt 111 on the polypropylene holder 91. The core 107 is electrically connected to the same conductor 95 as the electrode 97.

Figure 9:
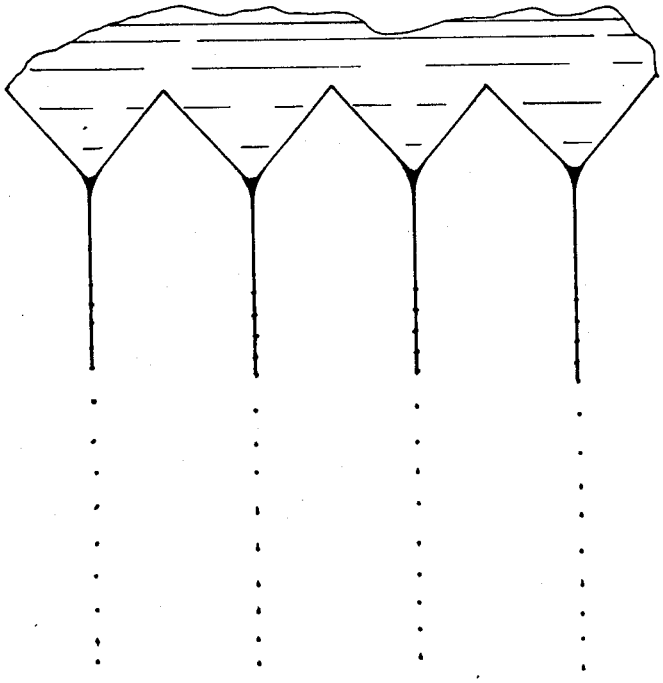
FIG. 9 is a side elevation of a toothed atomizing edge with liquid emerging therefrom in a further apparatus according to the invention.

The straight or circular edge or slot of a sprayhead may be formed with a series of teeth. In this case one ligament is formed at each tooth, as shown in FIG. 9, unless the teeth are too close together, when some teeth will not have ligaments, or too far apart, when some teeth may have more than one ligament. Alternatively, liquid may be atomized at a series of mutually spaced holes or points.

It is found that in certain sprayheads, for example certain sprayheads having linear atomizing edges or slots, there are benefits in terms of increased flow-rates and/or smaller droplets and of reliability to be obtained by providing a "semi-insulating" sheath to the electrodes of sprayheads which have a potential of the order of 1 to 20 KV applied to the sprayhead and an adjacent electrode at earth potential.

The method employed to measure the volume resistivity of materials suitable for use as the sheath 11 depends upon whether the material is available in sheet or tubular form.

For materials available in sheet form, such as melamine, BS 2782: Part 2: 1978: Method 202A was used.

In carrying out this method, a disc was cut from a melamine sheet and mercury electrodes applied to each surface of the disc. On one surface of the disc there was a circular measurement electrode of 5 cms. diameter and a guard ring electrode, concentric with the measurement electrode, of 7 cms. internal diameter. On an opposite surface of the disc there was a base electrode which covered the entire surface of the disc.

A positive terminal of a Brandenberg Model 2475R power supply was connected to the base electrode and a negative terminal of the supply was connected to the measurement electrode and to the guard ring electrode. To measure the applied voltage a Thurlby 1503-HA multimeter was connected between the positive and negative terminals of the supply. Current flowing between the measurement and base electrodes was measured by means of a Keithley Model 617 electrometer connected between the measurement electrode and the junction between the connections to the negative terminal of the supply and the guard ring electrode. The power supply provided approximately 500 volts and the input voltage burden of the electrometer was less than 1 mV, and no account was taken of the ammeter in computing resistivity.

With this arrangement of the volume resistivity, $\pi$, of the material is given by:

$$\rho = \frac{\pi\,(2.5)^2 \times 500}{i \times t}$$

where i is the measured current flow and t is the thickness of the disc.

For material available in the form of tubes, a cylindrical measurement electrode and two cylindrical guard electrodes are provided on an outer surface of the tube and a base electrode is provided inside the tube.

The measurement electrode had an axial length of 10 cms. and was disposed between the two guard electrodes. Each guard electrode was spaced from an adjacent end of the measurement electrode by a distance of 1 cm.

The measurement and guard electrodes were each formed of a metallized melinex film which extended from a film clamp to a first guide roller adjacent the tube, around the surface of the tube to a second guide roller, adjacent the first, and finally from the second guide roller to a film tensioning spring. To a close approximation, the film contacted the tube around the whole of its circumference. The electrical contact resistance between the film and the tube was low compared with the volume resistivity of the tube material.

The base electrode was formed of iron particles of 80 to 450 $\mu$ dimensions which were packed within the interior of the tube. An insulating plug was provided at each end of the tube.

A power supply and measuring instruments of the kind described above were employed.

As mentioned above, a "specific resistance" R was defined as the resistance across the wall of a section of the tube which is 1 cm. in length. The units were ohm. cms. and the wall resistance of a section of tube having an axial length of L cms. was obtained by dividing the specific resistance by L. Thus, the specific resistance when measured using the above-described electrode configuration was given by:

$$R = \frac{500 \times 10}{i} \text{ ohm. cms.}$$

where i is the measured current flow.

The resistivity of the material is then:

$$\rho = \frac{2\pi R}{\ln(ro/ri)}$$

where ro is the outer radius of the tube and ri is the inner radius of the tube.

The results of measurements on various materials, quoted both as a specific resistance and as a volume resistivity, were as follows:

| Sample | Specific Resistance | Volume Resistivity |
|---|---|---|
| 1. Soda Glass Tube id = 5.9 mm. od = 7.6 mm. | $1.9 \times 10^{12}$ Ωcm. | $4.6 \times 10^{13}$ Ωcm. |
| 2. Alumina Tube id = 3.4 mm. od = 8.0 mm. | *$1.7 \times 10^{15}$ Ωcm. | *$1.3 \times 10^{15}$ Ωcm. |
| 3. Concrete Tube id = 1.7 mm. od = 7.5 mm. | $2.4 \times 10^{10}$ Ωcm. | $1.0 \times 10^{11}$ Ωcm. |
| 4. Anglo-American Vulcanised Fibre Tube id = 4.1 mm. od = 10.0 mm. | **$3.6 \times 10^{12}$ Ωcm. | $2.5 \times 10^{13}$ Ωcm. |
| 5. Attwater Tube id = 3.9 mm. od = 9.6 mm. | **$1.2 \times 10^{12}$ Ωcm. | $8.4 \times 10^{12}$ Ωcm. |
| 6. Tufnol Tube id = 3.2 mm. od = 6.4 mm. | **$1.0 \times 10^{12}$ Ωcm. | $9.4 \times 10^{12}$ Ωcm. |
| 7. Melamine Disc | ***$1.1 \times 10^{11}$ Ωcm. | $6.2 \times 10^{11}$ Ωcm. |

*The voltage used to measure resistivity of the alumina was 1000 V.
**Phenol/formaldehyde paper tubes.
***Specific resistance for melamine was calculated from the resistivity for a tube of od = 6 mm., id = 2 mm.

It will be appreciated that a tube having a specific resistance R within the range $5\times10^{10}$ to $5\times10^{12}$ ohm cms., referred to above, can be obtained by having a thin-walled tube of relatively high volume resistivity or a thick-walled tube of relatively low volume resistivity.

The materials 1, 4, 5, 6 and 7 have a specific resistance and volume resistivity sufficiently low to allow charge leakage from the surface through the material to the conducting core of an electrode but sufficiently high to suppress sparking.

In the case of material 3, the specific resistance and volume resistivity are low. There is therefore excellent charge leakage. However, there is insufficient suppression of sparking with the result that spraying occurs only intermittently.

The material 2 has a high specific resistance and volume resistivity and there is insufficient charge leakage and a field strength which is too low for efficient spraying.

In the result, the materials 1, 4, 5, 6 and 7 are suitable for use as sheathing materials for electrodes in apparatus according to the invention. The materials 2 and 3 are unsuitable for such use.

It will be appreciated that the apparatus described above is suitable for spraying materials other than agricultural chemicals. For example, the apparatus is suitable for spraying paints of appropriate volume resistivity i.e. $10^6$ to $10^{11}$ ohm cms., particularly for spraying paints on to cars.

The apparatus can also be used for coating surfaces with oils, polymer solutions, solutions of release agents and solutions of corrosion inhibitors, again subject to appropriate volume resistivity.

We claim:

1. Electrostatic spraying apparatus comprising, an electrostatic sprayhead, means for applying a first electrical potential to liquid which emerges from the sprayhead, an electrode mounted adjacent the sprayhead, and means for applying a second electrical potential to the electrode such that an intense electrical field is developed between the emerging liquid and the electrode, the intensity of the field being sufficient to cause atomization of the emerging liquid, the electrode comprising a core of conducting or semiconducting material contained in a tubular sheath, characterized in that the sheath has a wall and the resistance of a section of the wall of said sheath which is 1 cm in length is within the range of $5\times10^{10}$ to $5\times10^{12}$ ohm cm.

2. Electrostatic spraying apparatus as claimed in claim 1, further comprising insulating means so arranged that the resistance to a flow of the said charge across the surface of the sheathing material to the said conducting or semi-conducting core is more than the resistance to a flow of the said charge through the tubular sheath to the conducting or semiconducting core.

3. Electrostatic spraying apparatus as claimed in claim 2, wherein the means for applying the second electrical potential includes an electrical conductor which is electrically connected to the conducting or semi-conducting core and has a cover of insulating material, and the insulating means is provided between engaging parts of the sheath and the cover.

4. Electrostatic spraying apparatus as claimed in claim 3, wherein the tubular sheath has an internal thread, the cover of the electrical conductor is formed with an external thread, the cover is threadably engaged with the tubular sheath, and the insulating means is provided between threadably engaging parts of the said cover and the said tubular sheath.

5. Electrostatic spraying apparatus as claimed in claim 1, 2, 3 or 4, wherein the volume resistivity of the sheathing material is between $5\times10^{11}$ and $5\times10^{13}$ ohm cms.

6. Electrostatic spraying apparatus as claimed in claim 1, 2, 3 or 4, wherein the dielectric strength of the sheathing material is greater than 15 KV/mm.

7. Electrostatic spraying apparatus as claimed in claim 6, wherein the thickness of the sheathing material is 0.75 to 5.0 mms.

8. Electrostatic spraying apparatus as claimed in claim 1, 2, 3 or 4, wherein the sheathing material is soda glass, phenol formaldehyde impregnated paper or a melamine formaldehyde condensation polymer.

9. Electrostatic spraying apparatus as claimed in claim 1, 2, 3 or 4, wherein the sprayhead includes a channel through which liquid flows to an orifice, at least one side wall of the channel which is contacted by the emerging liquid is formed of conducting or semiconducting material, and means are provided for electrically connecting the conducting or semiconducting side wall of the channel to the said means for applying the first electrical potential to the emerging liquid.

10. Electrostatic spraying apparatus as claimed in claim 1, 2, 3 or 4, wherein the sprayhead includes a channel through which liquid flows to an orifice, the or each side wall of the channel which is contacted by the emerging liquid is formed of an insulating material, a further electrode is provided adjacent to the orifice so that, in use, the further electrode is contacted by liquid flowing through the sprayhead, and means are provided for electrically connecting the further electrode to the means for applying the first electrical potential to the emerging liquid.

11. Electrostatic spraying apparatus as claimed in claim 10, wherein the sprayhead includes two mutually spaced, parallel arranged plates between which there is a channel for liquid to flow to a generally linear orifice, and the electrode comprises at least one electrode element which extends parallel or substantially parallel with the linear orifice.

12. Electrostatic spraying apparatus as claimed in claim 11, wherein the orifice is formed at adjacent edges of respective plates.

13. Electrostatic spraying apparatus as claimed in claim 12, wherein the orifice is formed at an edge of a first of the plates and an adjacent part of a second plate, the second plate having an edge which is generally parallel with but is located a short distance downstream of the said edge of the first plate.

14. Electrostatic spraying apparatus as claimed in claim 1, 2, 3, 4 or 11, wherein the sprayhead includes an orifice of generally circular section and the electrode is generally circular.

15. Electrostatic spraying apparatus as claimed in claim 1, 2, 3, 4 or 11, wherein the sprayhead includes an orifice of generally annular section and the comprises a generally ring-shaped electrode element and/or a generally disc-shaped electrode element.

16. Electrostatic spraying apparatus as claimed in claim 10, wherein the sprayhead is formed, adjacent the orifice with a series of teeth.

17. Electrostatic spraying apparatus as claimed in claim 1, 2, 3 or 4, wherein the second electrical potential has the same polarity as the first electrical potential and is intermediate the electrical potential and the potential of a target sprayed by the apparatus, the second potential being sufficiently different from the first potential for liquid to be atomized but sufficiently close to the first potential for droplets of the liquid to be repelled away from the sprayhead and towards the target.

18. Electrostatic spraying apparatus as claimed in claim 17 wherein, for spraying a target at zero potential, the first potential is between 25 KV and 50 KV, and the second potential is between 10 KV and 40 KV.

* * * * *